US005758587A

United States Patent [19]

Büchner et al.

[11] Patent Number: 5,758,587

[45] Date of Patent: Jun. 2, 1998

[54] PROCESS AND DEVICE FOR SUPPRESSION OF FLAME AND PRESSURE PULSATIONS IN A FURNACE

[75] Inventors: Horst Büchner, 3, rue du Margrave de Bade, F-67500 Marienthal, France; Wolfgang Leuckel, Auf der Judenhut 15, D-67098 Bad Dürkheim, Germany

[73] Assignees: Horst Büchner, Mariental, France; Wolfgang Leuckel, Bad Durkheim, Germany; DVGW Deutscher Verein des Gas- und Wasserfaches Technisch-Wissenschaftliche Vereinigung, Bonn, Germany

[21] Appl. No.: 682,230

[22] Filed: Jul. 17, 1996

[30] Foreign Application Priority Data

Jul. 20, 1995 [DE] Germany ..... 195 26 369.3
Nov. 16, 1995 [DE] Germany ..... 195 42 681.9

[51] Int. Cl.[6] ..... F23C 1/02

[52] U.S. Cl. ..... 110/260; 431/8; 431/181; 431/349; 110/264; 110/345

[58] Field of Search ..... 110/260, 263, 110/264, 345; 431/8, 9, 10, 181, 183, 187, 349, 350, 351

[56] References Cited

U.S. PATENT DOCUMENTS

| | | | |
|---|---|---|---|
| 1,258,654 | 3/1918 | Cram | 431/187 |
| 1,950,044 | 3/1934 | Wilson | 431/8 |
| 2,138,998 | 12/1938 | Brosius | 431/187 |
| 2,360,548 | 10/1944 | Conway | 431/187 |
| 3,681,003 | 8/1972 | Nekrasov et al. | 431/353 |
| 4,357,134 | 11/1982 | Katsushige et al. | 431/9 |
| 4,473,348 | 9/1984 | Tikhonovich et al. | 431/1 |
| 4,919,611 | 4/1990 | Flament | 431/350 |
| 5,199,355 | 4/1993 | Larue | 110/261 |
| 5,263,849 | 11/1993 | Irwin et al. | 431/6 |
| 5,284,437 | 2/1994 | Aigner | 431/4 |
| 5,295,816 | 3/1994 | Kibayashi et al. | 431/9 |
| 5,567,141 | 10/1996 | Joshi et al. | 431/8 |

FOREIGN PATENT DOCUMENTS

| | | |
|---|---|---|
| 36 09 622 A1 | 12/1986 | Germany . |
| 36 36 787 A1 | 5/1988 | Germany . |
| 33 31 989 C2 | 9/1988 | Germany . |
| 43 39 094 A1 | 5/1995 | Germany . |

*Primary Examiner*—Henry A. Bennett
*Assistant Examiner*—Pamela A. O'Connor
*Attorney, Agent, or Firm*—Panitch Schwarze Jacobs & Nadel, P.C.

[57] ABSTRACT

A process and apparatus are provided for suppressing flame and pressure pulsations in a furnace which has a burner for generating a flame and a combustion chamber into which the flame is directed. Usually, pressure pulsations can occur in such furnaces, which are induced and amplified by ring vortices rolling up on the outer or peripheral regions of the flame and or fuel/air stream. In order to prevent these ring vortices, it is proposed to surround the flame with an envelope of gas which has a higher flow velocity in the direction of the flame than the peripheral region of the flame or the fuel gas/air flow of the burner, whereby a boundary layer acceleration results, and the vortex formation can no longer take place. The furnace burner is provided with one or more gas discharge openings closely surrounding the burner outlet in order to create the gas envelope.

20 Claims, 3 Drawing Sheets

PROCESS AND DEVICE FOR SUPPRESSION OF FLAME AND PRESSURE PULSATIONS IN A FURNACE

FIELD OF THE INVENTION

The invention concerns a process for suppressing flame and pressure pulsations in a furnace which has a burner with which a flame is generated and a combustion chamber into which the flame is directed, as well as an appropriate device for implementing the process.

BACKGROUND OF THE INVENTION

With industrial combustion facilities, such as gas turbine combustion chambers, hot-blast furnaces, residue combustion chambers or industrial furnaces, but also with small furnaces such as gas boilers or heating boilers in the domestic use range, under certain conditions established by the technical operating parameters of the furnace, such as thermal load and the air equivalence ratio, unstable operating conditions occur which are characterized by periodic changes in the flame over time. These unstable conditions accompany particularly changes in static pressure in the combustion chamber, as well as in facility parts connected before and after the chamber. These unstable conditions also occur in furnaces whose flames are sufficiently ignition-stabilized by known measures, such as swirling flows, bluff-body stabilizer, etc.

The occurrence of these combustion instabilities often induces a changed behavior in comparison with the steady-state operation of the facility, and also causes an intensified mechanical and/or thermal stress to the combustion chamber or the combustion chamber lining in addition to increased sound emission. Such flame and pressure pulsations can lead under unfavorable circumstances to destruction of the facility in which they occur, so that great expenditures are made to avoid flame and pressure pulsations of this type. Thus, for example, the geometry of the combustion chamber has been changed through special components which, however, frequently leads only to a shift in the pulsation frequencies occurring, and consequently does not lead to a general solution of the problem. Otherwise, special measures are undertaken in any given case on an empirical basis when flame and pressure pulsations occur.

SUMMARY OF THE INVENTION

Accordingly, underlying the present invention is the object of developing a process with which such flame and pressure pulsations with non-tolerable pressure amplitudes can be avoided.

To fulfill this object, it is suggested in accordance with the invention to envelope the flame of the burner as closely as possible with a stream of gas which has a higher flow velocity in the direction of flame propagation than the outer or peripheral regions of the flame or the fuel-containing main flow of the burner. A transmission of axial momentum to the outer regions of the flame or fuel-containing burner stream is thereby effected.

The invention resides therefore in the recognition of the principle that the pulsations are basically caused or amplified by turbulent ring vortices being formed in the edge region of the flame. These ring vortices, which arise by rolling up of the edge zones of the flue-containing burner stream, incorporate hot fuel gases as they form, which causes the fuel-air mixture likewise contained in the ring vortex to heat up rapidly, and induces an impulse-type reaction of the fuel which gives rise to pressure pulsations.

In order to prevent the formation of ring vortices, the gas is surrounded at the least possible radial distance to the flame or the burner main flow with a gas envelope stream, which has a higher flow velocity in the direction of flame propagation than the outer or peripheral regions of the flame. An axial momentum exchange thereby results between the envelope stream and the flame or fuel gas/air stream, which causes an acceleration of the free flame or boundary layer flow of the fuel/air mixture, and thereby effectively counteracts the formation of reactive vortices in this region.

As far then as corresponding ring vortices occur at the boundary layer between the gas envelope stream and the surrounding medium (including the case of general flue gases), it is most advantageous if the gas envelope stream contains no fuel, since then no vortices which include fuel can form from the (fuel-free) envelope stream which could otherwise lead to a periodic reaction of fuel and thereby to an inducement of flame or pressure pulsations as they occur with a non-enveloped flame or fuel/air stream.

Preferably, the non-fuel-containing gas used is air, which is available everywhere in sufficient quantity. Use of an inert gas is also, however, conceivable, which can have a certain cost disadvantage as a consequence.

Even if the gas envelope stream contains fuel, the effect in accordance with the invention of an acceleration of the outer regions of the burner outflow (or the main stream forming the flame) can be attained, whereby various cases can be distinguished in this regard with reference to the medium of the gas envelope stream:

Should the gas envelope stream consist of a non-ignitable mixture of gas and fuel, the gas envelope stream basically behaves as if it contained no fuel with respect to its action in the suppression of the formation of reactive ring vortices. That is, vortices possibly arising in the boundary layer between the gas envelope stream and the surrounding medium cannot react and therefore do not lead to the inducement or amplification of flame and pressure pulsations. With this non-ignitable mixture of gas and fuel, the gas used could be an inert gas (for example, nitrogen, water vapor or burned out exhaust gases) as well as air, whereby in the former case the fuel concentration is irrelevant, since inert gas cannot react, that is burn with fuel in any mixture proportion, while in the second case the fuel concentration lies outside the ignition limits of the fuel in question, so that even here ring vortices arising from the gas envelope stream cannot react.

Basically, a fuel/air mixture having fuel concentrations within the ignition limits, depending upon the respective fuel, can be used as a gas envelope stream medium if the essentially axial outflow velocity of this in principle combustible gas envelope stream is selected so high in comparison with the burner main stream that, on the one hand a sufficient transmission of axial momentum is guaranteed, and thereby a sufficient acceleration of the outer regions of the flame or burner main stream, while on the other hand, however, the formation of a self-supporting stable flame (or several flames in the case of several individual discharge openings of the gas envelope stream) from the gas envelope stream is prevented. That is, the discharge velocity of the gas envelope stream is distinctly higher than the critical blow-off velocity for a flame.

The gas envelope stream preferably runs parallel to the central axis of the flame. It can, however, also have a certain radial or tangential component in relation to this flame or main stream direction of the fuel/air current in addition, from which follows a certain expansion of the gas envelope along the direction of the flame, whereby it should be taken into consideration that not all burners have flames with cross sections which do not change in the critical region, but that flames can likewise assume the conical form described. At the same time, it is always essential that the gas envelope stream have a sufficiently high axial momentum in comparison with the non-enveloped flame or fuel/air stream.

For implementing this process for suppressing flame and pressure pulsations in a furnace, a furnace in accordance with the invention having a burner for generating a flame and a combustion chamber into which the flame is directed also has at least one gas discharge opening from which exits the gas in the form of an envelope which surrounds the flame.

The distance between the gas discharge opening and the edge of the fuel exit from which the fuel/air mixture flows should be kept as small as possible.

Since the process of the invention indicated above can be used with premix combustion as well as with diffusion combustion, especially with liquid or gas fuel, the burners are accordingly adapted to these types of combustion control mentioned for implementing this process in a known manner for any given case.

Preferably, the gas discharge opening for generating the gas envelope stream is constructed as a slot or an aperture nozzle, and closely surrounds the burner outlet, whereby the burner outlet can be constructed axially symmetrically, but can also have a longitudinal cross section form.

With the axially symmetrical burner outlet, the slot is then constructed as a ring aperture nozzle which is especially arranged concentrically and at a close distance around the burner outlet.

Instead of a single slot or a single aperture nozzle, a plurality of smaller gas discharge openings can surround the burner outlet and these are set at a close distance to each other. It also applies in this connection that the burner outlet and the overall arrangement of the gas discharge openings, preferably constructed as nozzles, are arranged concentrically, and that a gas envelope stream completely surrounding the flame of the burner is generated by the plurality of gas discharge openings or nozzles as well, which suppresses the occurrence of ring vortices.

It must be seen in this connection that basically the burner outlet and nozzle(s) do not have to be arranged in a plane, so long as it is assured that the gas envelope flowing around the flame can induce a sufficient acceleration of the peripheral regions of the flame in the critical areas to prevent formation of vortices.

This is especially fulfilled when the outflow direction of the nozzles is essentially parallel to the burner axis. However, a gas stream which emerges from the nozzles and envelops the flame in its peripheral region can also be attained by an appropriate angled positioning of the nozzles toward the burner axis.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENT

Figure 1:
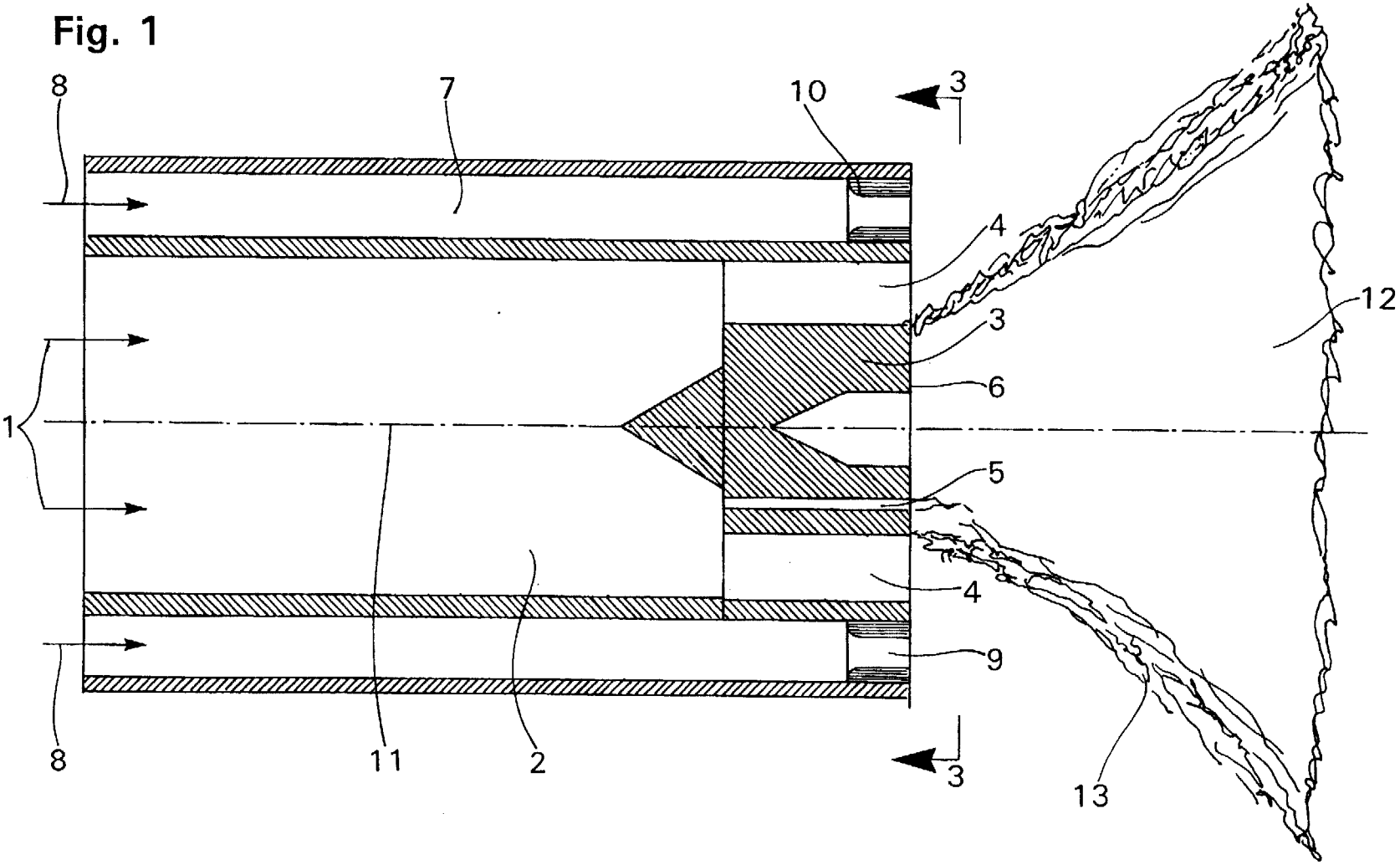
FIG. 1 is a cross-section through a burner for implementing the process of the invention.
Figure 2:
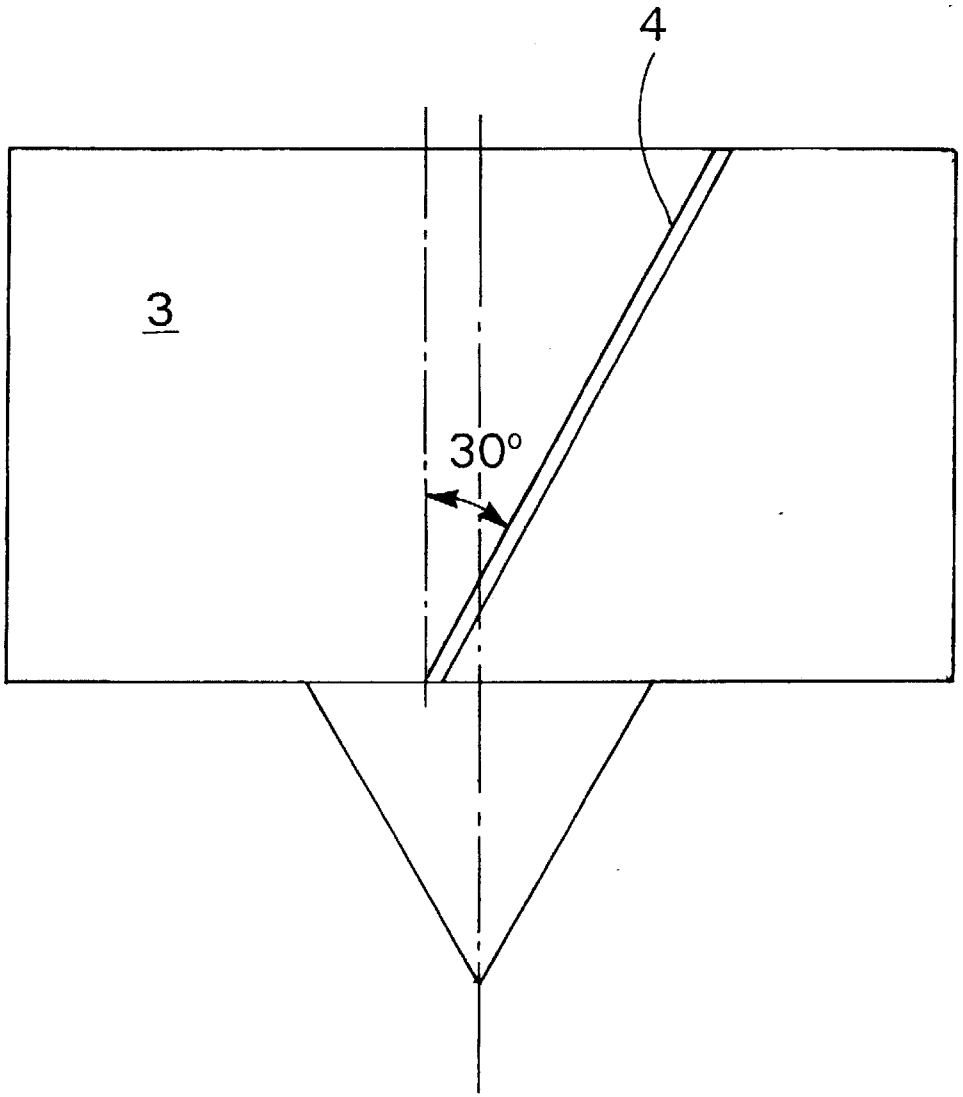
FIG. 2 is a side view of the swirling crosspiece shown in FIG. 1.

A burner for implementing the process of the invention is depicted in FIG. 1. This embodiment involves a swirling burner to which a premixed fuel gas/air mixture 1 is admitted across a burner tube 2. This burner tube terminates in a swirling crosspiece 3, which is axially symmetrical and has inclined axial guide vanes 4 on its outer circumference. These axial guide vanes have an inclination of about 30° through which the exiting fuel gas/air mixture acquires a deflection, and therewith a swirl, as shown in FIG. 2. In addition, several bored holes 5 penetrating the swirl crosspiece 3 are radially distributed around the circumference somewhat further inward than the guide vanes 4, through which holes a partial current of the fuel gas/air mixture can flow, and thus contribute to flame stabilization by formation of pilot flames. On the exterior 6 of the swirl crosspiece, the fuel gas/air mixture emerging from the burner is ignited and forms a flame 12, which enters into a combustion chamber not depicted in FIG. 1.

Figure 3:
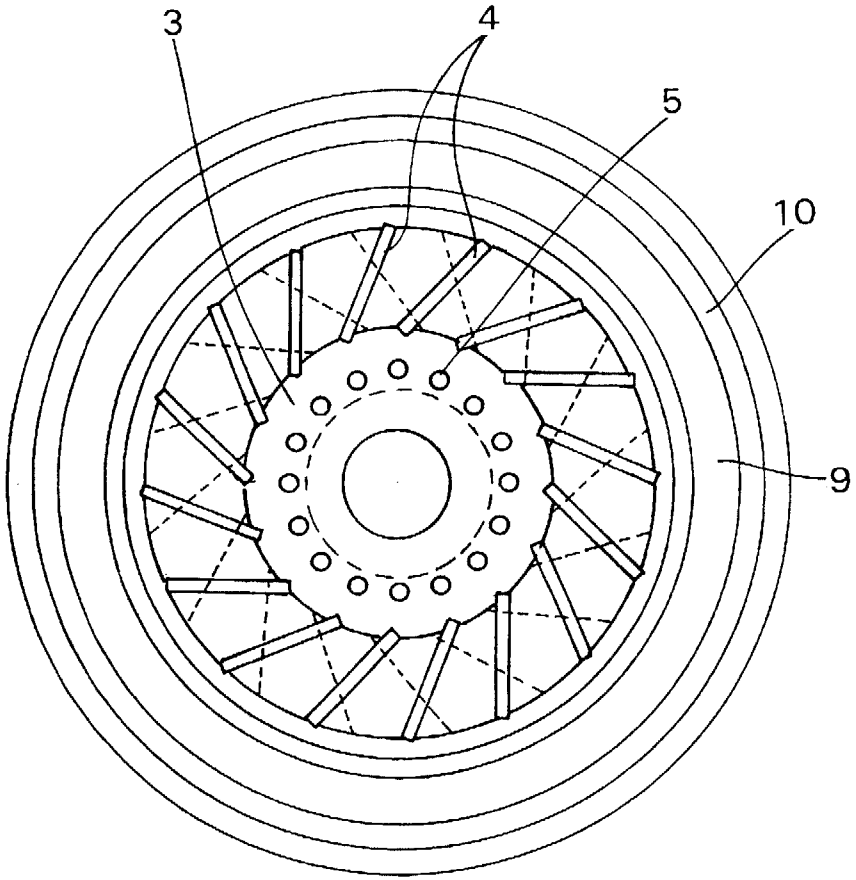
FIG. 3 is a view taken along line 3—3 in FIG. 1.

An envelope of gas flows around the flame 12 of the burners. This envelope is induced by a gas current 8 which is conducted through the burner through a ring canal 7 parallel to the burner tube 2 and exits from the burner at a ring slot 9, shown in FIG. 3, which surrounds the swirling cross piece 3 set at a close distance. In order to accelerate the gas current 8 prior to its exit from the ring canal, quadrant jets or nozzles 10 are installed in the end region of the ring canal which impart a strong axial acceleration especially to the outer regions of the gas envelope stream (that means parallel to the burner axis 11). In this case, the gas stream forms an essentially cylindrical envelope.

The flow velocity of the outer parts of the gas envelope stream exiting from the ring slot 9 is accelerated by means of the quadrant jets 10 to such an extent that the velocity in the direction of the axis 11 is considerably higher than that of the burning fuel gas/air mixture in the direction of the flame behind the swirl crosspiece 3, whereby a boundary layer acceleration of the burning fuel gas/air mixture takes place in the region between the fuel gas/air mixture burning in a flame and the gas envelope stream closely surrounding it. Thereby, effective prevention is achieved of formation of periodic, coherent ring vortex structures occurring in the edge region 13 of the fuel gas/air mixture, which would otherwise stimulate and intensify flame and pressure pulsations by a rapid reaction of the fuel contained in it, due to an in-phase energy conduction.

Consequently, a simple but highly effective possibility is provided for surely preventing flame and pressure pulsations of this type, thereby increasing the operational safety of the corresponding furnace facilities.

Figure 4:
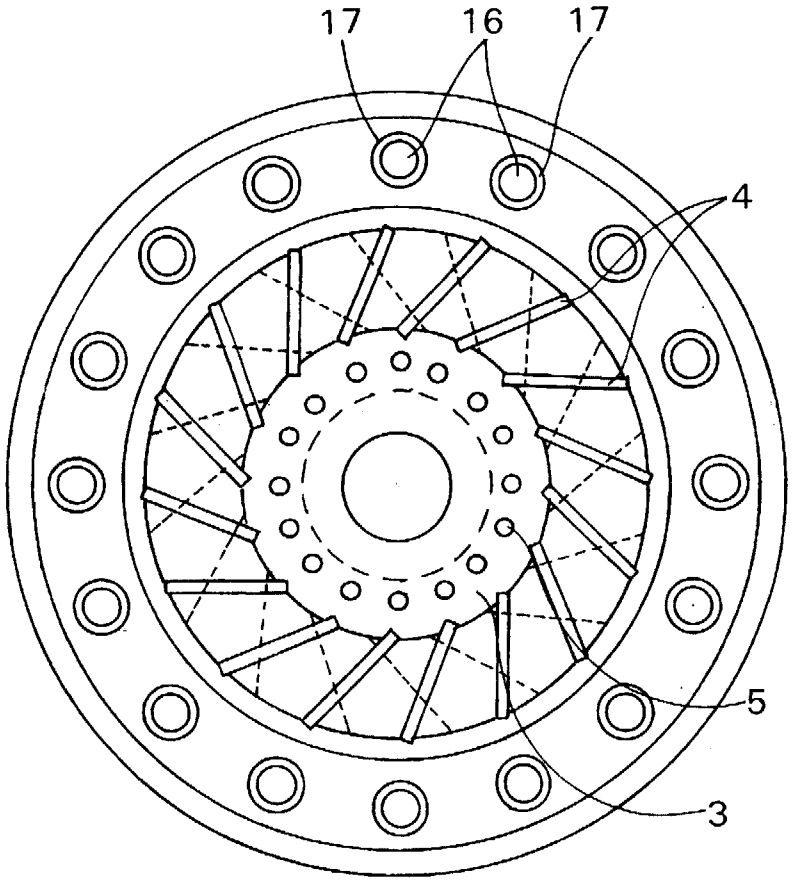
FIG. 4 is a view similar to FIG. 3 of another embodiment of the invention.

Referring now to FIG. 4, an alternative embodiment of the invention is shown in which the ring slot 9 has been replaced with a plurality of closely spaced gas discharge openings 16 having jets 17 to accelerate the gas current 8 prior to its exit from the ring canal. The gas discharge openings 16 form a gas envelope stream which completely surrounds the flame, in a similar manner to the ring slot 9.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A process for suppressing flame and pressure pulsations in a furnace having a burner for generating a flame and a combustion chamber into which the flame is directed, comprising surrounding the flame with a gas envelope stream which has a higher flow velocity in a flame propagation direction than the velocity of edge regions of the flame, where ring vortices tend to arise by rolling up of edge zones of a fuel-containing burner stream which incorporates hot flue gases.

2. The process according to claim 1, wherein the gas does not contain fuel.

3. The process according to claim 1, wherein the gas contains fuel.

4. The process according to claim 3, wherein the gas is a fuel/air mixture which contains fuel in a concentration outside an ignition range for the fuel and the air in the mixture.

5. The process according to claim 3, wherein the gas is a fuel/air mixture which contains fuel in a concentration within an ignition range for the fuel and the air in the mixture.

6. The process according to claim 1, wherein the gas is air.

7. The process according to claim 1, wherein the gas is an inert gas.

8. The process according to claim 7, wherein the inert gas is selected from the group consisting of nitrogen, water vapor and burned-out exhaust gas.

9. The process according to claim 1, wherein the gas stream forms an essentially cylindrical envelope.

10. The process according to claim 1, wherein the gas stream is at a close distance to the outer regions of the flame.

11. The process according to claim 1, wherein the gas has a flow direction parallel to the direction of the flame.

12. The process according to claim 11, wherein the flow direction of the gas has in addition at least one of a radial and a tangential component in relation to the direction of the flame.

13. A furnace for suppressing flame and pressure pulsations, comprising a burner for generating a flame, a combustion chamber into which the flame is directed, and at least one gas discharge opening for emitting a gas stream in a form of an envelope to surround the flame, the opening having a nozzle for accelerating the gas envelope stream to a higher flow velocity in a flame propagation direction than a velocity of edge regions of the flame where ring vortices tend to arise by rolling up of edge zones of a fuel-containing burner stream which incorporates hot flue gases.

14. The furnace according to claim 13, wherein the gas discharge opening is in a form of a slot and surrounds an outlet of the burner proximate thereto.

15. The furnace according to claim 14, wherein the burner outlet is axially symmetrical and the slot is a ring slot.

16. The furnace according to claim 15, wherein the burner outlet and the ring slot are arranged concentrically.

17. The furnace according to claim 13, wherein an outlet of the burner is surrounded by a plurality of gas discharge openings said discharge openings serving to form a gas envelope stream to completely surround the flame.

18. The furnace according to claim 17, wherein the gas discharge openings are concentrically arranged around the burner outlet.

19. The furnace according to claim 13, wherein the at least one gas discharge opening is in the form of a restricted-diameter nozzle.

20. The furnace according to claim 13, wherein an outflow direction of the gas discharge opening is essentially parallel to a central axis of the burner.

* * * * *